United States Patent [19]

Chung et al.

[11] Patent Number: 5,048,820

[45] Date of Patent: Sep. 17, 1991

[54] COMPACT SORTER

[75] Inventors: Jae H. Chung, Uijongbu; Jeong H. Kim, Seoul, both of Rep. of Korea

[73] Assignee: Sindo Ricoh Co., Ltd., Seoul, Rep. of Korea

[21] Appl. No.: 495,795

[22] Filed: Mar. 16, 1990

[30] Foreign Application Priority Data

Jan. 25, 1990 [KR] Rep. of Korea ..... 1990-855

[51] Int. Cl.[5] ..... B65H 39/10

[52] U.S. Cl. ..... 271/293; 271/294

[58] Field of Search ..... 271/292-294

[56] References Cited

U.S. PATENT DOCUMENTS

| | | | |
|---|---|---|---|
| 4,328,963 | 5/1982 | DuBois et al. . | |
| 4,332,377 | 6/1982 | DuBois et al. . | |
| 4,337,936 | 7/1982 | Lawrence | 271/293 |
| 4,343,463 | 8/1982 | Lawrence . | |
| 4,397,461 | 8/1983 | DuBois et al. . | |
| 4,433,837 | 2/1984 | Romanowski . | |
| 4,466,608 | 8/1984 | DuBois et al. . | |
| 4,466,609 | 8/1984 | Lawrence . | |
| 4,478,406 | 10/1984 | DuBois . | |
| 4,500,087 | 2/1985 | Dubois . | |
| 4,589,653 | 5/1986 | Stemmle . | |
| 4,843,434 | 6/1927 | Lawrence et al. . | |
| 4,872,663 | 10/1989 | Latone | 271/294 |
| 4,925,171 | 5/1990 | Kramer et al. | 271/293 |

FOREIGN PATENT DOCUMENTS

| | | | |
|---|---|---|---|
| 59-215895 | 5/1984 | Japan . | |
| 232370 | 11/1985 | Japan | 271/293 |
| 2168037 | 6/1986 | United Kingdom . | |

*Primary Examiner*—H. Grant Skaggs

*Attorney, Agent, or Firm*—Michael N. Meller

[57] ABSTRACT

A compact sorter for sorting copied papers is disclosed which comprises: slot liners, a transfer wheel, and a plurality of bin trays, and is characterized in that the middle portion of the slot liner which is formed in each of side plates of the sorter body is bent toward the ejecting section of the copy machine within the radius of gyration of the transfer wheel, in such a manner that the bin trays for loading the copied papers should advance one by one to directly below the ejecting roller, so that the ejected papers should be exactly received into the correct position of each of the bin trays. According to the present invention, vertical and horizontal movements of the bin trays are made to be possible, and both the bin tray which has completed the receiving of a copied paper and the bin tray which has been waiting are made to be simultaneously moved, thereby providing continuous operations and a reduced installation space.

10 Claims, 4 Drawing Sheets

COMPACT SORTER

FIELD OF THE INVENTION

The present invention relates to a compact sorter as a peripheral equipment of a copy machine, which is capable of arranging the copy sheets from the ejecting section of the copying machine based on the order of the pages, and particularly to a compact sorter in which a bin tray installed in a slot liner ascends in accordance with the revolution of a transfer wheel.

BACKGROUND OF THE INVENTION

As shown in FIG. 4, the conventional copy sorter is constituted such that: a copy sheet 51 ejected from the copying machine enters the space between an upper guide plate and a lower guide plate; then upper and lower rollers 50, 49 installed near a transfer wheel 58 and an auxiliary paper supplying unit installed separately are driven so that the copy sheet 51 is loaded upon a bin tray 39; and at the same time, the transfer wheel 58 is revolved to pick up pins 52 disposed at the opposite ends of the bin tray 39, so that the pins 52 should be moved in the vertical direction within a slot liner 53 having a vertically elongate shape such that the trays diverge to a certain gap, thereby forming a vertical linear slot liner type sorter (U.S. Pat. No. 4,466,608)

However, in such a type of sorter, only the up and down movements of the bin trays are possible, the stand-still position of the bin trays is located externally to the transfer wheel all the time, and a seperate paper supplying unit is required to overcome the separation between the bin tray and the ejecting section of the copying machine.

Another type of conventional sorter as disclosed in U.S. Pat. No. 4,589,653 is constituted such that a protuberance formed on a bin tray is picked up by means of a notch of a piped C-cam driven by a motor, so that the bin tray should be lifted or lowered. This type of sorter has the disadvantage of requiring a plurality of auxiliary units for lifting or lowering the bin tray.

Still another type of sorter as disclosed is U.S. Pat. No. 4,500,087 is constituted such that the lifting motion of the bin tray is generated by picking up a bottom pin by means of a wire winding method, while the lowering motion of the bin tray is generated by pushing the end of the bin tray by means of a solenoid connected to a pusher. In such a type of sorter, a slot liner of a vertical linear form is utilized, and therefore, only the up and down movements of the bin tray are possible, in addition to the fact that the driving means is complicated and inefficient.

Still another of sorter type as disclosed on U.S. Pat. No. 4,466,609 and 4,478,406 is constituted such that a spiral drum cam is utilized to generate up and down movements of the bin tray. This type includes the disadvantages that only simple up and down movements of the bin tray are possible, and a seperate conveyor unit is required for loading the copy sheets to the exact position on the bin tray.

U.S. Pat. No. 4,433,837 is constituted such that the middle portion of a slot liner is bent in an arcuate manner toward the tray, and a revolving ratchet picks up a pin, such that the pin is lifted by means of the end of the arcuate portion. Such an arrangement is for lifting the pin by means of the slot liner in a natural manner, and generates only simple up and down movements. Further, the distance between the bin tray and the ejecting roller of the copier is too large, and therefore, there is the disadvantage that the copy sheets discharged from the ejecting roller of the copying machine cannot be received at the exact position of the bin tray after natural drops from the ejecting roller.

U.S. Pat. No. 4,397,461 is constituted such that, without using a slot liner, the end portion of the bin tray is formed downwardly contrary to the preceding method, such that the bin tray is aligned in an unloaded state, thereby forming a free drop type. In the use of such a sorter, the action of taking out the copies from the tray becomes very unstable, and therefore, end users avoid the use of such products.

U.S. Pat. No. 4,343,463 is constituted such that a bin tray is installed on a vertically linear type slot liner such that the bin tray moves up and down owing to the function of a spiral drum cam. This sorter is designed such that it should be applicable only to the ejecting section of a copy machine of a special type, and therefore, it is accompanied by a limitation that it cannot be used for ordinary copy machines.

U.S. Pat. No. 4,328,963 and 4,432,377 are constituted such that a slot liner on which a bin tray is installed is bent toward the ejecting section of the copy machine, in such a manner that its middle portion has a vertical form. In this way, an effect almost the same as that of the preceding vertical slot liner types is achieved. That is, the bin tray is able to perform only up and down movements within the range of the transfer wheel, and therefore, as in the cases of the preceding types, a distance between the bin tray and the ejecting roller is formed, thereby making the loading of the copies unreliable.

SUMMARY OF THE INVENTION

Therefore it is the object of the present invention to provide a compact sorter in which all the above described disadvantages of the conventional techniques are overcome.

In achieving the above object, the compact sorter according to the present invention is constituted such that: the path of the slot liner is bent in the form of a wedge toward the ejecting roller within the radius of gyration of the transfer wheel such that the bin tray is movable vertically and horizontally and the copies are stacked in the order in which they are ejected; and upon stopping of the transfer wheel, the position of the bin tray is located at a certain point on the curved slot liner such that the starting point is at a certain point on the curved portion of the slot liner, and an upward protuberance of the bin tray is advanced to the lower end of the ejecting roller, thereby making it possible to exactly position the copies even without an auxiliary paper supplying unit.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
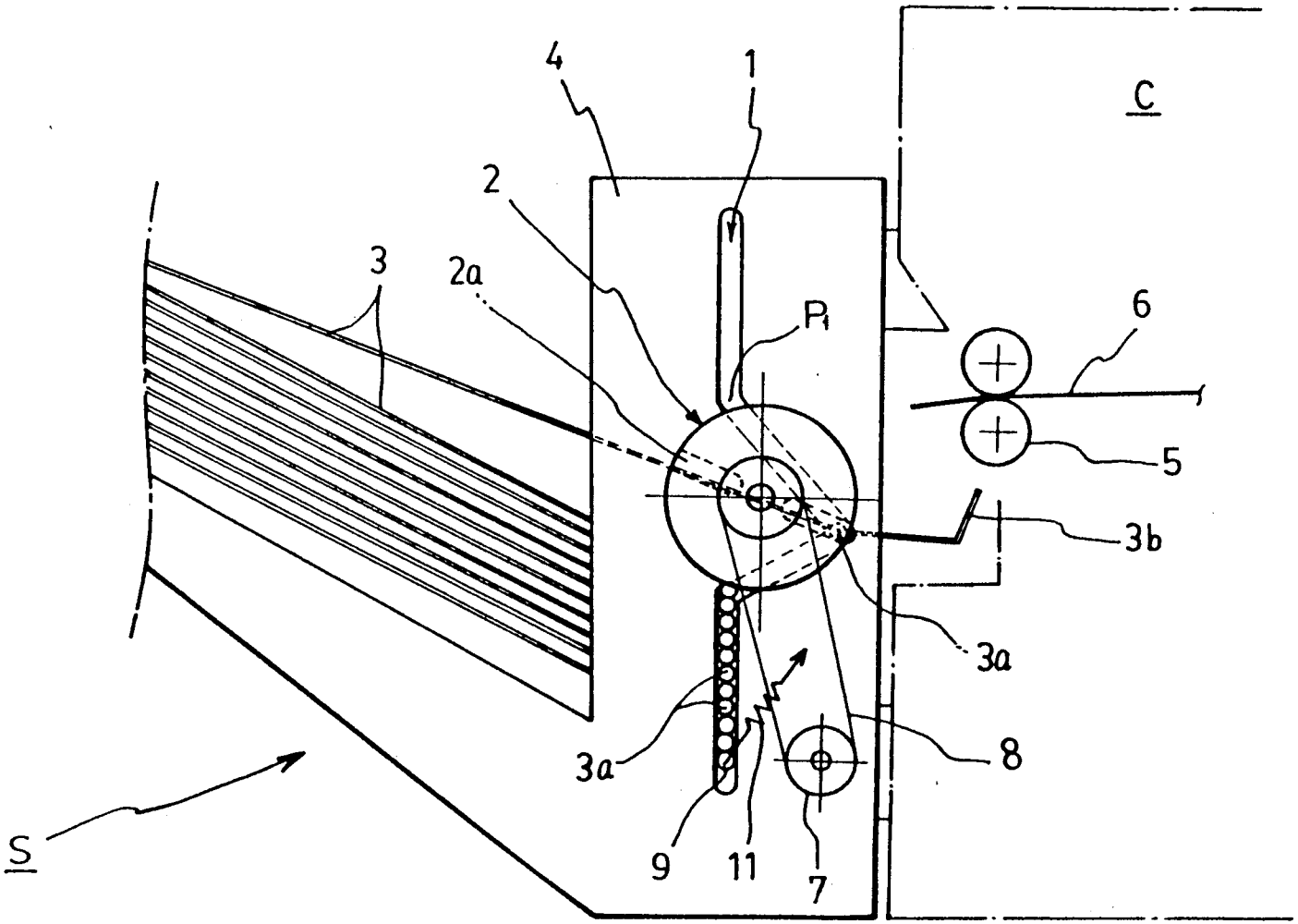
FIG. 1 is a frontal view of the compact sorter of the present invention installed.

The compact sorter according to the present invention is of the type in which up and down movements of a bin tray 3 are achieved by means of a slot liner 1 and a transfer wheel 2.

The slot liner 1 is provided in the vertical form on each of the opposite side plates 4 of the sorter body S, and another portion of the slot liner 1, i.e., the portion of the slot liner 1 which comes within the radius of gyration of the transfer wheel 2, is angled toward the ejecting section of the copy machine, in such a manner that an upward projection 3*b* of the end of the bin tray 3 to be loaded should be placed directly below an ejecting roller 5 of the ejecting section, thereby making it possible for the copies to be received and loaded.

FIG. 1 is a schematical frontal view showing that the sorter body S is installed on the ejecting section of a copy machine C. The slot liner 1 according to the present invention is formed in the vertical direction by cutting out each of the opposite side plates 4, and the transfer wheel 2 which is the driving element is installed in the angled portion of the slot liner 1, in such a manner that it is connected to a driving gear 7 by means of a timing belt 8. A base pin 9 which is positioned at the lower end of the slot liner 1 is pulled upwardly by means of a spring 11, so that a pin 3*a* of the bin tray 3 is urged upwardly all the time.

Figure 2:
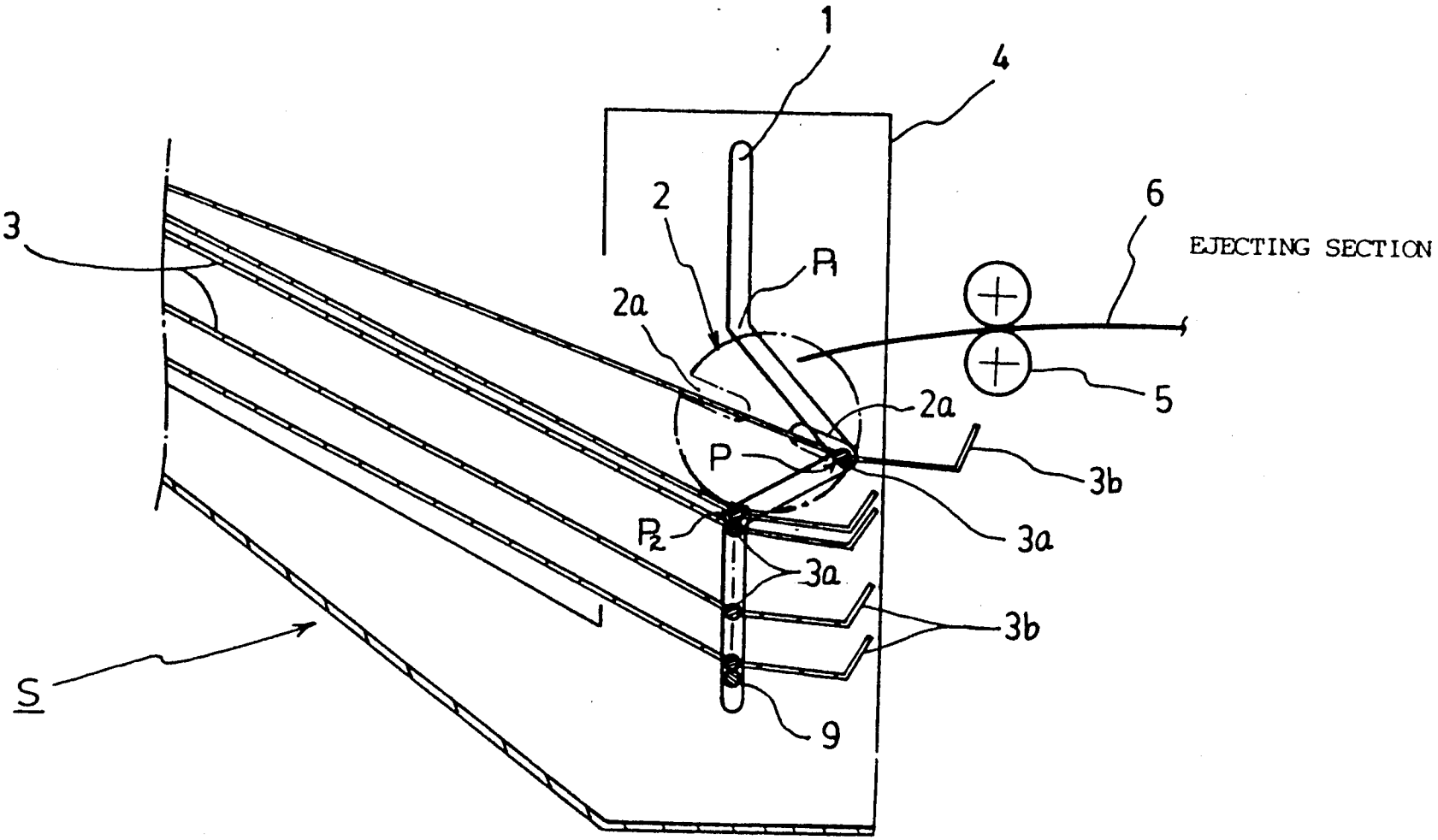
FIG. 2 is a longitudinal sectional view of the compact sorter of FIG. 1 (initial state)
Figure 3:
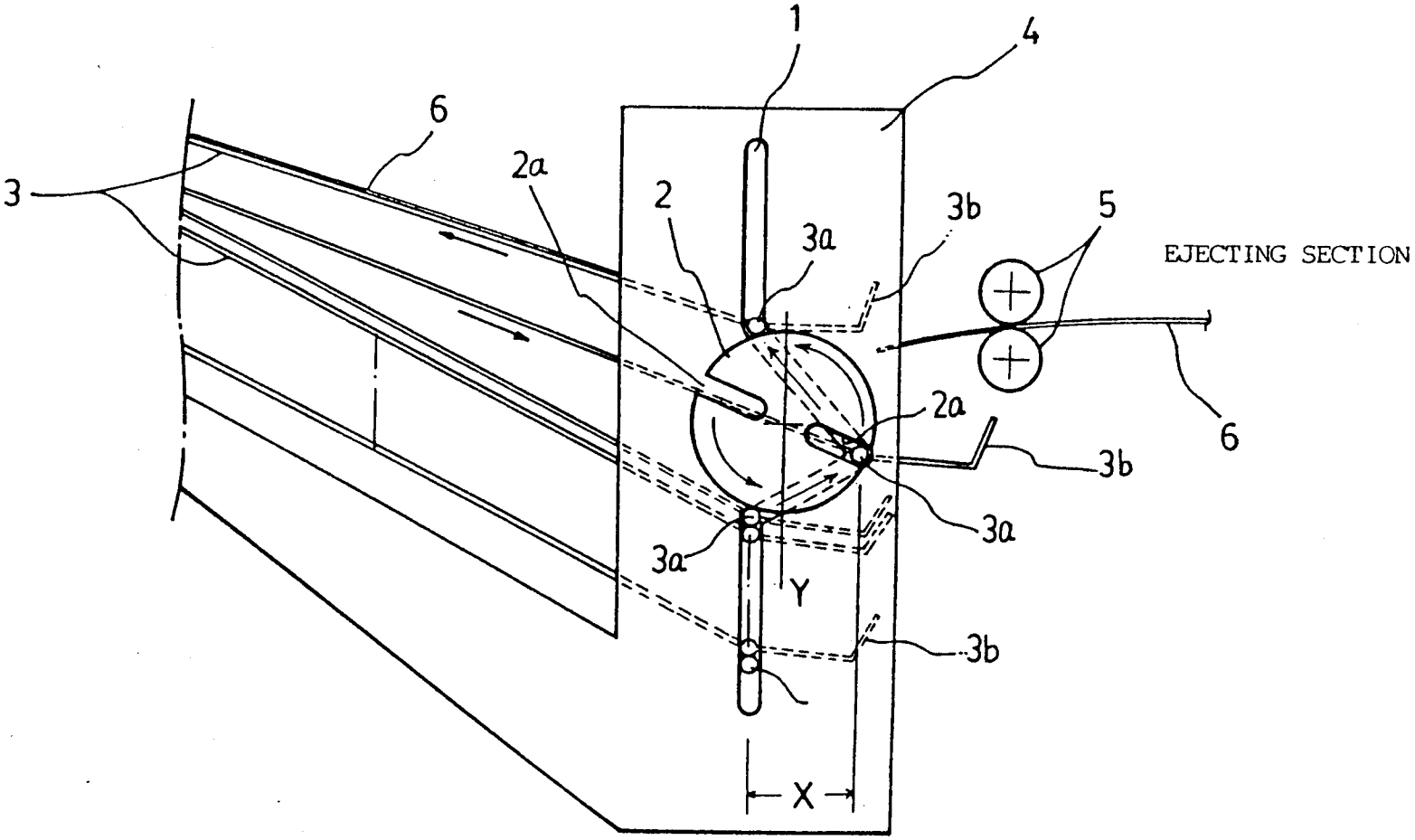
FIG. 3 illustrates a state in which the transfer wheel has been revolved by 180 after loading of the first copy onto the first tray.
Figure 4:
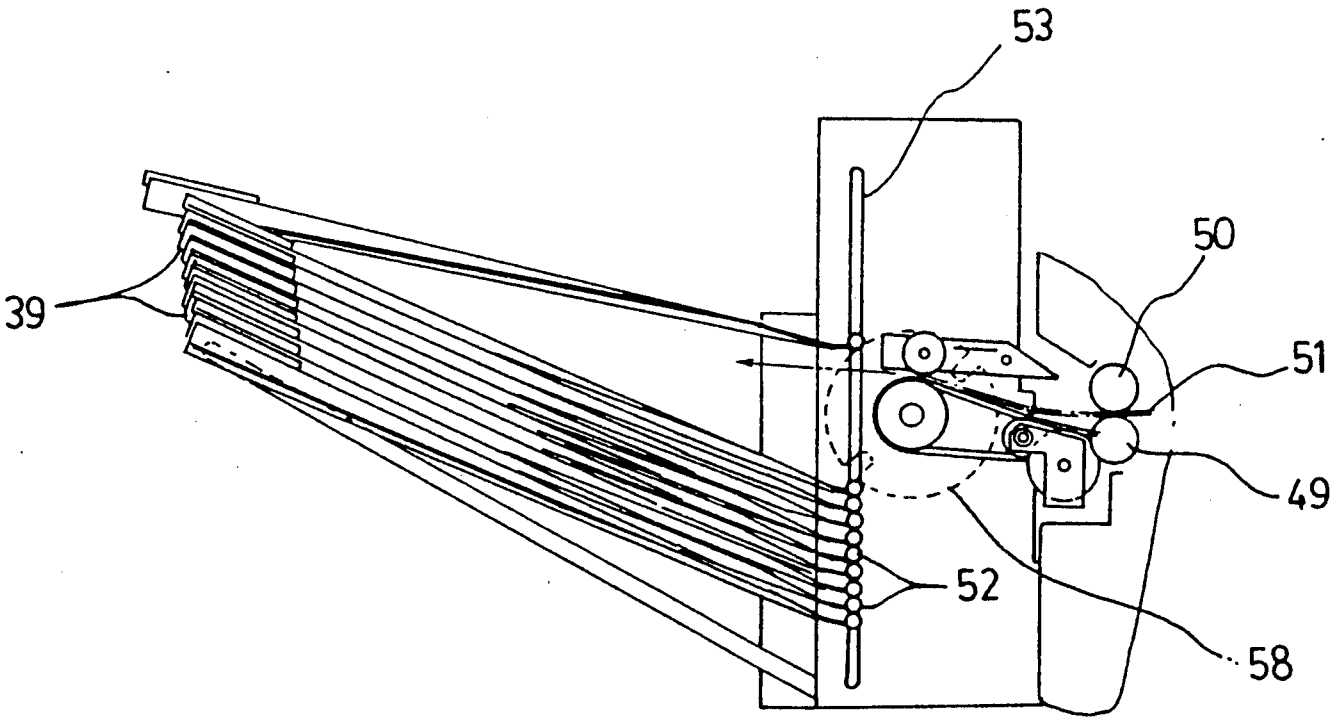
FIG. 4 is an examplary view of one of the conventional sorters.

As shown in FIG. 1 to 3, the angled portion of the slot liner 1 is formed such that the path of the slot liner 1 is angled within the radius of gyration of the transfer wheel 2, thereby enabling simultaneous control of the vertical and horizontal movements of the bin tray 3. Further, the horizontal movement of the bin tray 3 starts from the outside of the vertical center Y of the transfer wheel 2, and advances toward the ejecting section of the copy machine C. This assures the maximum extension of the horizontal displacement X, and this, in turn, assures that the portion which is extended from the pin 3*a* of the bin tray 3 protrudes from the sorter body 8.

The upward projection 3*b* formed at the end of the bin tray 3 advances toward the ejecting section upon revolution of the transfer wheel 2 by one half revolution (180), so that the copy 6 ejected from the copy machine C is received. Whenever the revolution of the transfer wheel 2 is stopped, the pin 3*a* stops at a certain point P within the bent angled portion of the slot liner 1. Therefore, when the receiving motion point for the copy is located at the certain point P within the angled portion, that is, when one of the bin trays 3 enters into the ejecting section to stop at the certain point P of the angled portion of the slot liner 1 such that the bin tray 3 is located below the ejecting roller 5, and the ejection of a copy is carried out.

The transfer wheel 2 of the present invention is provided with slots 2*a* opposing each other in order to pick up the pin 3*a* of the bin tray 3, and therefore, both the bin tray 3 which has completed the receiving of a copy 6 during one half revolution of the transfer wheel 2, and another bin tray 3 which has been waiting, are simultaneously lifted and lowered, so that continuous receptions can be carried out.

The compact sorter according to the present invention constituted as above will now be described as to its operations and effect.

The initial state is shown in FIG. 2 in which the pin 3*a*of the uppermost bin tray 3 is located at the certain point P of the angled portion of the slot liner 1, and its upper projection 3*b* is located directly below the ejecting roller 5 of the ejecting section. If a copying is carried out in such an initial state, the copy 6 is guided by the ejecting roller 5 of the ejecting section, and is received into the bin tray 3 which has been advanced to directly below the ejecting roller 5.

Under this conditions, a motor (not shown) is activated to drive the driving gear 7, and as shown in FIG. 3, the transfer wheel 2 is revolved counterclockwise upon receipt of the dynamic power from the timing belt 8. That is, in a state in which the pin 3*a* of the bin tray 3 loaded with a copy and located at the certain point P of the slot liner 1 engages the slot 2*a* of the transfer wheel 2, the transfer wheel 2 is revolved, and therefore, the pin 3*a* is elevated along the leftwardly sloped path of the angled portion of the slot liner 1 to reach an upper turning point P1.

At this point, the path of the slot liner 1 turns to the vertical direction, and therefore, the rising pin 3*a* is disengaged from the slot 2*a* of the transfer wheel 2. At the same time, an upper pin 3*a* which has been pulled upwardly by the spring 11 and has been located at the lower turning point P2 is inserted into the opposite slot 2*a*, and therefore, the pin 3*a* is picked up to be advanced along the rightwardly sloped path until it reaches the certain point P. The revolving angle of the transfer wheel 2 is 180, and this angle is controlled by means of a separate limit switch automatically.

Through the operation of such continuous repetitions, the bin trays which are placed in the lower portion of the slot liner are transferred one by one by the transfer wheel, which in turn revolves in correspondence with the ejecting of the copies, so that the copies should be sort-stacked based on the page criteria.

Meanwhile, if all the bin trays are elevated to the uppermost portion of the slot liner, then the revolution of the transfer wheel is reversed to pull down the bin trays to the lower portion of the slot liner for reuse. Here, if the copyings are performed in a reversed page order, then the sorting can be performed during the descending of the bin trays.

As described above, according to the present invention, the conventional vertical linearity of the slot liner is eliminated and instead, the middle portion of the slot liner is angled toward the ejecting roller within the radius of gyration of the transfer wheel, the angle being formed in the shape of a wedge. Thus, it is arranged that the copying is performed in a state with one of the bin trays arranged below the ejecting roller, thereby making it possible to sort without a separate auxiliary paper supplying unit.

Further, the installation space for the sorter is reduced, the total bulk of the copy machine is reduced to a compact type, as well as reducing the manufacturing cost.

Particularly, vertical and horizontal movements of the bin trays are made possible through the revolution of the transfer wheel, and the starting point of each of the bin trays is located at a certain point on the angled portion, while the bin tray which has received a copy and a bin tray which has been waiting are simultaneously moved, thereby providing continuous operations and upgrading its practicality.

What is claimed is:

1. A compact sorter for a copy machine having means for ejecting copies, comprising:

a sorter body having opposing side plates, each of said side plates having a slot liner, said slot liner having first and second vertical portions connected by a middle portion which extends through points horizontally displaced relative to said vertical portions toward said ejecting means of said copy machine;

a plurality of bin trays, each tray having pin means which ride in said slot liner of each of said side plates and a projection extending on the side of said pin means closest to said ejecting means;

a transfer wheel rotatably mounted on said sorter body, said transfer wheel having first and second slots arranged along a diameter of said transfer wheel and extending radially inward from a circumference of said transfer wheel, said slots being dimensioned to receive said pin means and said transfer wheel having a radius of gyration and said slots having a length such that a part of each of said slots overlies a part of said middle portion over respective predetermined angles of each revolution of said transfer wheel substantially all of said middle portion of said slot liner lying within said radius of gyration of said transfer wheel;

means for urging said pin means in said first vertical portion toward said transfer wheel; and driving means for rotating said transfer wheel, whereby said respective pin means are successively transported from said first to said second vertical portion by said transfer wheel during rotation thereof and said respective projections are successively transported closer to said ejecting means during travel of said pin means along said middle portion.

2. Apparatus as claimed in claim 1 wherein said projection of said bin tray is an upward projection which is placed directly beneath said ejecting means of said copy machine to receive said ejected copy during rotation of said transfer wheel.

3. Apparatus as claimed in claim 2 wherein said projection of said bin tray moves out of said sorter body for receiving said copy from said ejecting means.

4. Apparatus as claimed in claim 1 wherein said projection of said bin tray is moved into position to receive said copy from said ejecting means during one half cycle of rotation of said transfer wheel.

5. Apparatus as claimed in claim 1 wherein said middle portion of said slot liner has two parts, a first part for receiving the pin means of a bin tray to be transported towards said ejecting means of said copy machine to receive the ejected copy and a second part for receiving said pin means of said bin tray containing said ejected copy and transporting said bin tray away from said ejecting means.

6. Apparatus as claimed in claim 5 wherein one bin tray is transported along said first part of said middle portion simultaneously with a second bin tray being transported along said second part of said middle portion during rotation of said transfer wheel.

7. Apparatus as claimed in claim 1 wherein said transfer wheel has a vertical center and said middle portion of said slot liner extends from one side of said vertical center of said transfer wheel to the other said of said vertical center.

8. Apparatus as claimed in claim 7 wherein said middle portion of said slot liner has two parts, each of said parts extending from one side of said vertical center of said transfer wheel to the other side of said vertical center.

9. Apparatus as claimed in claim 1 wherein said transfer wheel stops rotating when said pin means reaches a selected position of said middle portion of said slot liner.

10. Apparatus as claimed in claim 9 wherein said projection of said bin tray is placed directly beneath said ejecting means of said copy machine when said pin means is in said selected position.

* * * * *